US010106906B2

(12) United States Patent
Kimura et al.

(10) Patent No.: US 10,106,906 B2
(45) Date of Patent: Oct. 23, 2018

(54) PLATING APPARATUS

(71) Applicant: EBARA CORPORATION, Tokyo (JP)

(72) Inventors: Masaaki Kimura, Tokyo (JP); Mitsutoshi Yahagi, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 253 days.

(21) Appl. No.: 15/058,108

(22) Filed: Mar. 1, 2016

(65) Prior Publication Data

US 2016/0258080 A1 Sep. 8, 2016

(30) Foreign Application Priority Data

Mar. 5, 2015 (JP) ..... 2015-043306

(51) Int. Cl.

| | |
|---|---|
| ***C25D 17/08*** | (2006.01) |
| ***C25D 17/02*** | (2006.01) |
| ***C25D 17/06*** | (2006.01) |
| ***C25D 17/12*** | (2006.01) |
| ***C25D 17/00*** | (2006.01) |

(52) U.S. Cl.

CPC ..... *C25D 17/08* (2013.01); *C25D 17/001* (2013.01); *C25D 17/007* (2013.01); *C25D 17/008* (2013.01); *C25D 17/02* (2013.01); *C25D 17/06* (2013.01); *C25D 17/12* (2013.01)

(58) Field of Classification Search

None

See application file for complete search history.

(56) References Cited

U.S. PATENT DOCUMENTS

| | | | | |
|---|---|---|---|---|
| 3,979,275 A * | 9/1976 | Harvey | C25C 1/12 | 204/198 |
| 4,537,663 A * | 8/1985 | Macdonald | C25D 5/04 | 204/225 |
| 4,933,061 A * | 6/1990 | Kulkarni | C25D 17/02 | 204/224 R |
| 6,911,128 B2 * | 6/2005 | Klose | C02F 1/46109 | 204/242 |
| 8,177,944 B2 | 5/2012 | Saito et al. | | |

(Continued)

FOREIGN PATENT DOCUMENTS

| | | |
|---|---|---|
| JP | 09-053198 A | 2/1997 |
| JP | 11-195622 A | 7/1999 |

(Continued)

*Primary Examiner* — Harry D Wilkins, III

(74) *Attorney, Agent, or Firm* — Baker & Hostetler LLP

(57) ABSTRACT

There is disclosed a plating apparatus which can dispose an anode, a substrate and a regulation plate parallel to each other in such a manner that the center of the anode, the center of the substrate and the center of an opening of the regulation plate are aligned in a straight line. A frame of the plating apparatus includes: a support for supporting upper portions of an anode holder, a substrate holder and the regulation plate; a box structure secured to the support; an upper positioning structure for fixing a relative position between the support and the upper portions of the anode holder, the substrate holder and the regulation plate; and a lower positioning structure for fixing a relative position between the box structure and lower portions of the anode holder, the substrate holder and the regulation plate.

13 Claims, 16 Drawing Sheets

(56) References Cited

U.S. PATENT DOCUMENTS

| | | | | |
|---|---|---|---|---|
| 2009/0139871 | A1* | 6/2009 | Saito | C25D 21/10 205/148 |
| 2012/0298502 | A1* | 11/2012 | Papapanayiotou | C25D 17/001 204/237 |
| 2012/0298504 | A1* | 11/2012 | Guarnaccia | C25D 17/002 204/252 |

FOREIGN PATENT DOCUMENTS

| | | | |
|---|---|---|---|
| JP | 2009-155726 | A | 7/2009 |
| WO | WO 2005/042804 | A2 | 5/2005 |

* cited by examiner

PLATING APPARATUS

CROSS REFERENCE TO RELATED APPLICATION

This document claims priority to Japanese Patent Application Number 2015-043306 filed Mar. 5, 2015, the entire contents of which are hereby incorporated by reference.

BACKGROUND

Electroplating is a technique which involves applying a voltage between a substrate, such as a wafer, and an anode to form a metal film on a surface of the substrate. An electroplating apparatus for performing electroplating will be described with reference to FIG. 17. As shown in FIG. 17, the plating apparatus includes a plating tank 101 for holding a plating solution therein, an anode 102 disposed in the plating tank 101, an anode holder 103 for holding the anode 102, and a substrate holder 104 for holding a substrate W. The anode 102 and the substrate W are disposed such that they are opposite each other in the plating solution.

The plating apparatus further includes a regulation plate 106 for regulating the distribution of electric potential on the substrate W. The regulation plate 106 is disposed between the substrate W and the anode 102, and has an opening 106*a* which allows passage of an electric current that flows from the anode 102 to the substrate W.

The anode 102 is coupled via the anode holder 103 to the positive pole of a power source 107, while the substrate W is coupled via the substrate holder 104 to the negative pole of the power source 107. When a voltage is applied between the anode 102 and the substrate W, an electric current flows from the anode 102 to the substrate W through the opening 106*a* of the regulation plate 106, so that a metal film is formed on the surface of the substrate W.

In order to make the thickness of the metal film uniform, it is important to set the anode holder 103, the substrate holder 104 and the regulation plate 106 such that the anode 102, the substrate W and the regulation plate 106 are parallel to each other, and that the center of the anode 102, the center of the substrate W and the center of the opening 106*a* of the regulation plate 106 are aligned in a straight line. In view of this, a positioning holder 108 for holding upper portions of the anode holder 103, the substrate holder 104 and the regulation plate 106 may be provided above the plating tank 101.

However, the positioning holder 108 may deform due to the weights of the anode holder 103, the substrate holder 104 and the regulation plate 106. This may cause the anode 102, the substrate W and the regulation plate 106 to lean, and can therefore cause the center of the anode 102, the center of the substrate W and the center of the opening 106*a* of the regulation plate 106 to be out of alignment. With the recent demand for enhanced uniformity of a thickness of a metal film to be formed on the substrate W, there is a demand for more accurate positioning of the anode 102, the substrate W and the regulation plate 106.

SUMMARY OF THE INVENTION

According to an embodiment, there is provided a plating apparatus which can dispose an anode, a substrate and a regulation plate parallel to each other in such a manner that the center of the anode, the center of the substrate and the center of the opening of the regulation plate are aligned in a straight line.

Below-described embodiments relate to a plating apparatus for plating a substrate such as a wafer, and more particularly to a plating apparatus which can align an anode, an electric field regulation plate and a substrate in a straight line.

In an embodiment, there is provided a plating apparatus comprising: a plating tank; a substrate holder for holding a substrate; an anode holder for holding an anode; a regulation plate for regulating the distribution of electric potential on the substrate held by the substrate holder; and a frame for positioning the substrate holder, the anode holder and the regulation plate in the plating tank, the frame including: a support for supporting upper portions of the anode holder, the substrate holder and the regulation plate; a box structure fixed to the support; an upper positioning structure for fixing a relative position between the support and the upper portions of the anode holder, the substrate holder and the regulation plate; and a lower positioning structure for fixing a relative position between the box structure and lower portions of the anode holder, the substrate holder and the regulation plate.

In an embodiment, the upper positioning structure is provided on the support, and the lower positioning structure is provided in the box structure.

In an embodiment, the upper positioning structure includes at least a positioning protrusion to be inserted into a positioning hole formed in the substrate holder.

In an embodiment, the support is made of a metal.

In an embodiment, the box structure has a shape that surrounds the anode holder and the regulation plate supported by the support.

In an embodiment, the box structure is made of a material capable of blocking an electric field.

According to the above-described embodiments, the support is reinforced by the box structure, and the positions and angles of the anode holder, the substrate holder and the regulation plate are fixed by the positioning structures. The anode holder, the substrate holder and the regulation plate can therefore be set on the frame in such a manner that they are parallel to each other, and that the center of the anode, the center of the substrate and the center of the opening of the regulation plate are aligned in a straight line.

DESCRIPTION OF EMBODIMENTS

Figure 1:
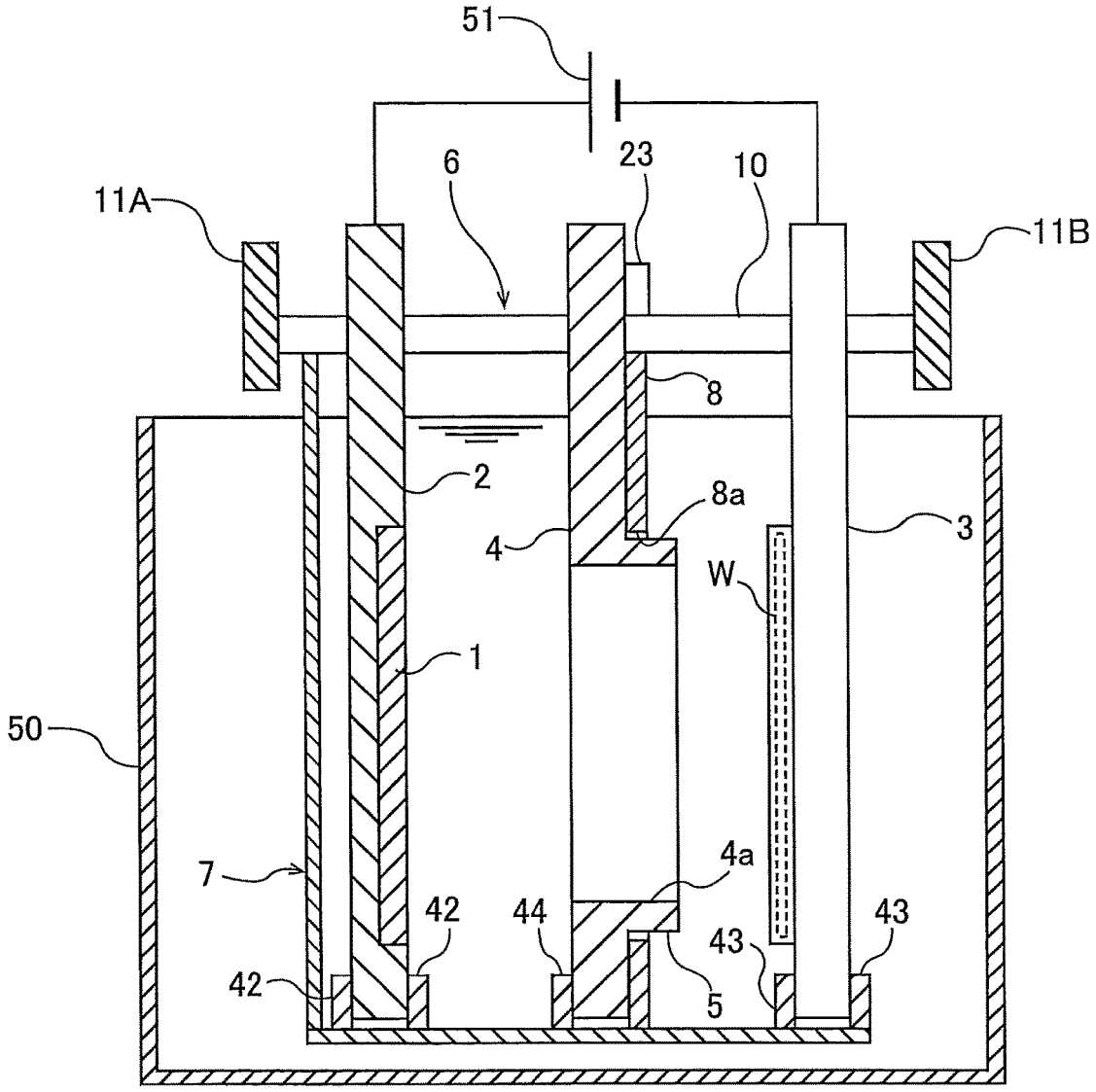
FIG. 1 is a cross-sectional side view showing an embodiment of a plating apparatus.

Embodiments will now be described with reference to the drawings. FIG. 1 is a cross-sectional side view showing an embodiment of a plating apparatus. The plating apparatus includes an anode 1, an anode holder 2 for holding the anode 1, a substrate holder 3 for holding a substrate W such as a wafer, a regulation plate 4 for regulating a distribution of electric potential on the substrate W, a frame 6 for supporting the anode holder 2, the substrate holder 3 and the regulation plate 4, a plating tank 50 for holding a plating solution therein, and a power source 51 for applying a voltage between the substrate W and the anode 1. The anode 1 and the substrate W are disposed such that they are opposite each other in the plating tank 50.

The regulation plate 4 is disposed between the anode holder 2 and the substrate holder 3. The regulation plate 4 has a cylindrical portion 5 having a circular or vertically-elongated elliptical opening 4*a* that allows passage of an electric current flowing from the anode 1 to the substrate W. The regulation plate 4 is disposed between the anode 1 and the substrate W such that the front end of the cylindrical portion 5 faces the substrate W.

The frame 6 is a base structure (i.e., a support structure) for supporting the anode holder 2, the regulation plate 4 and the substrate holder 3, and fixing their positions and angles. More specifically, when the anode holder 2 holding the anode 1, the substrate holder 3 holding the substrate W, and the regulation plate 4 are placed on the frame 6, the anode 1, the substrate W and the regulation plate 4 become parallel to each other, and the center of the anode 1, the center of the substrate W and the center of the opening 4*a* of the regulation plate 4 are aligned in a straight line.

The frame 6 is disposed in the plating tank 50. The anode holder 2 and the regulation plate 4 are set on the frame 6 before a plating solution is supplied into the plating tank 50. The substrate holder 3 holding the substrate W is set on the frame 6 after the plating solution is supplied into the plating tank 50, i.e. immediately before carrying out plating of the substrate W.

Plating of the substrate W is performed in the following manner: When the anode 1, the substrate W, and the regulation plate 4 are immersed in the plating solution, a voltage is applied from the power source 51 to between the anode 1 and the substrate W. An electric current flows from the anode 1 to the substrate W through the opening 4*a* of the regulation plate 4, and a metal is deposited on the surface of the substrate W. An electric field formed between the anode 1 and the substrate W is restricted by the regulation plate 4.

Figure 2:
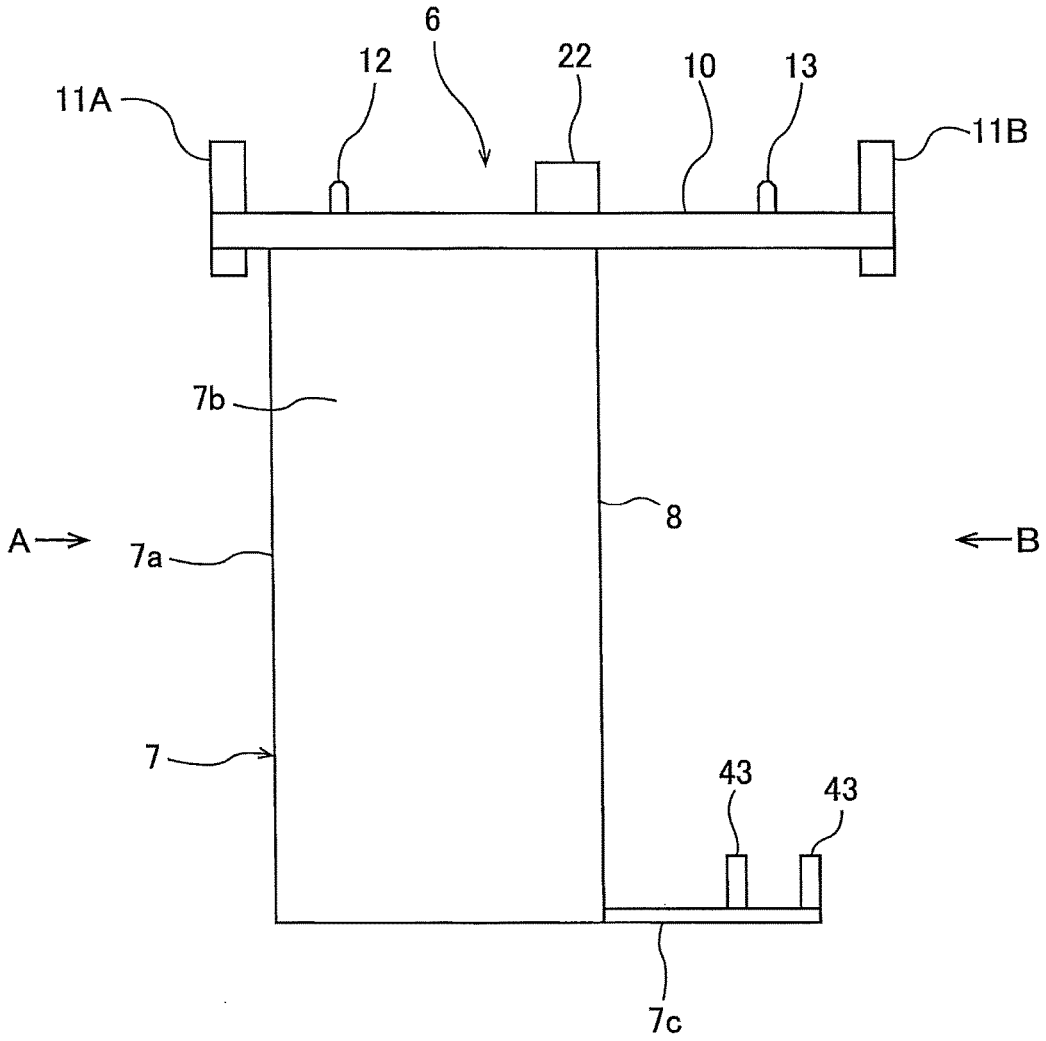
FIG. 2 is a side view of a frame of the plating apparatus.
Figure 3:
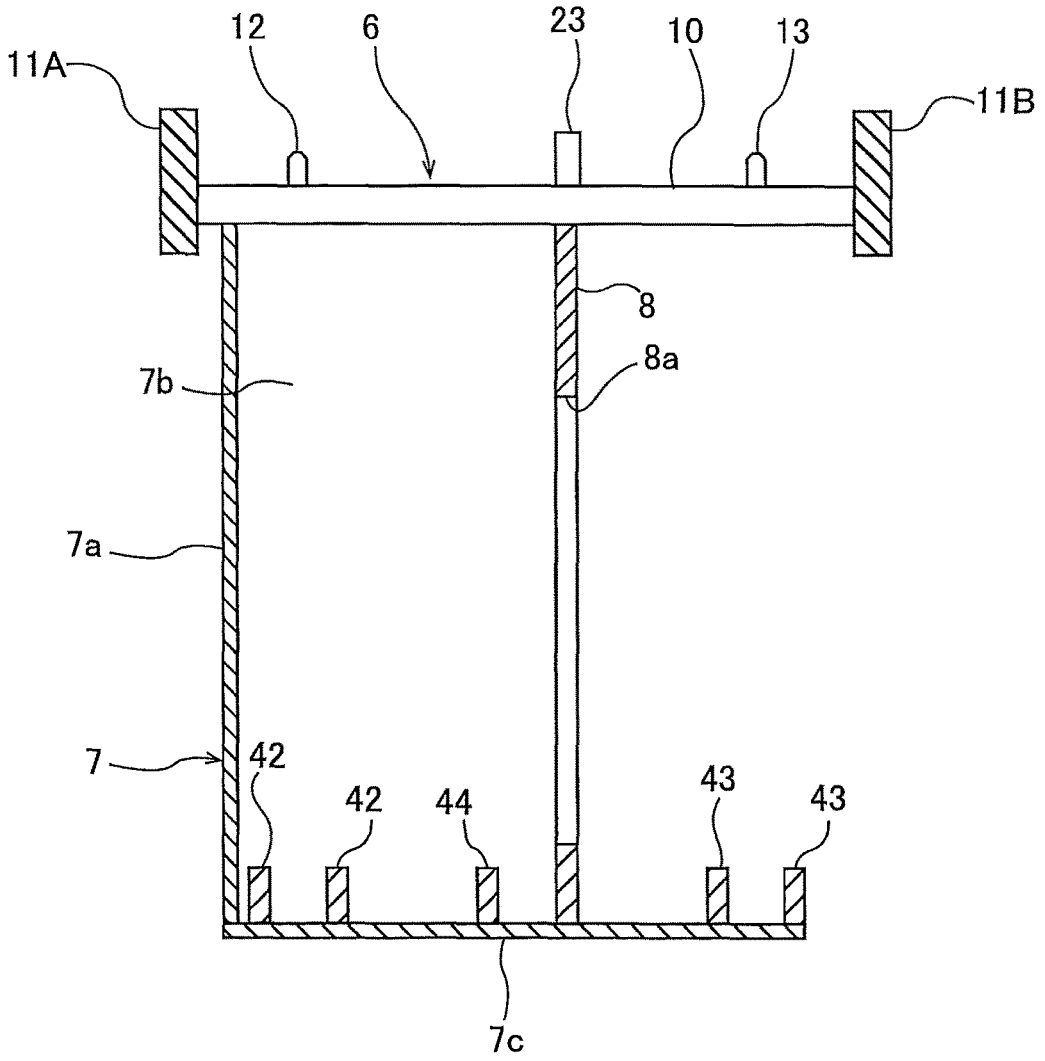
FIG. 3 is a cross-sectional side view of the frame.
Figure 4:
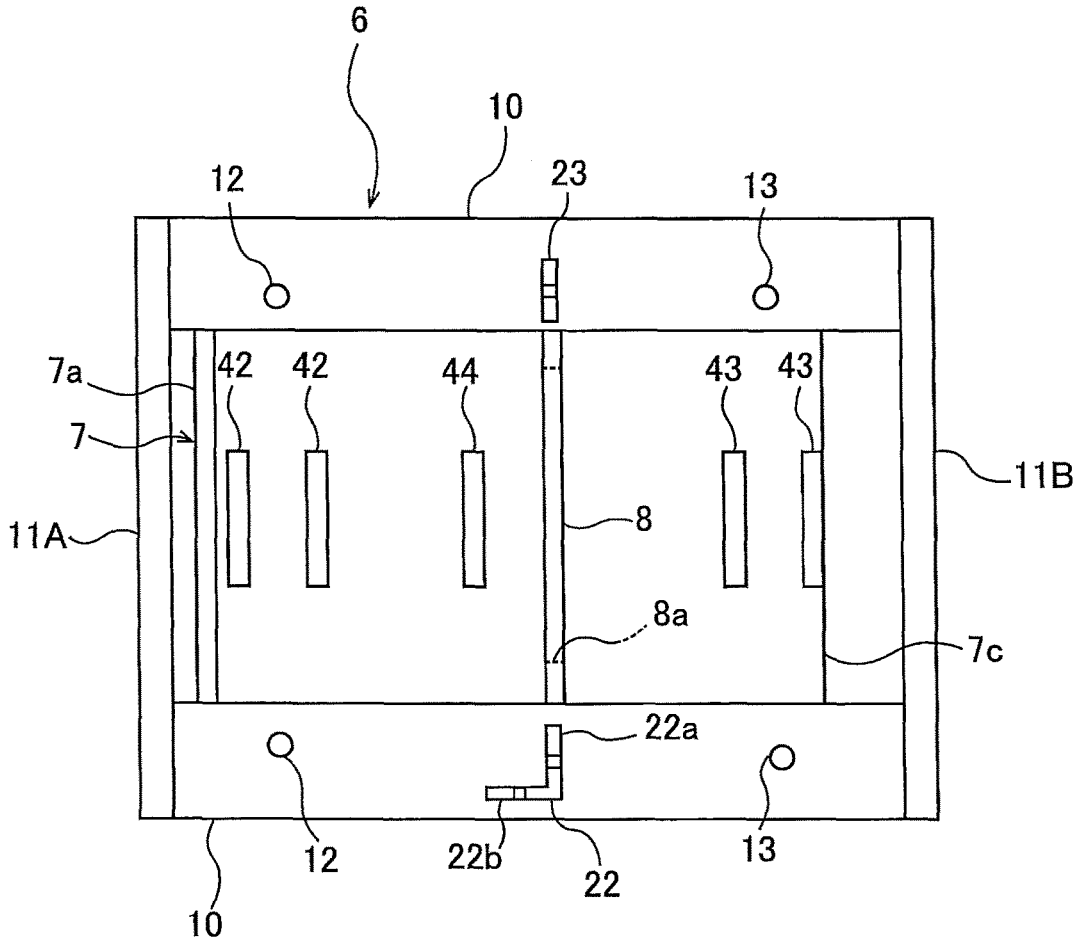
FIG. 4 is a plan view of the frame.
Figure 5:
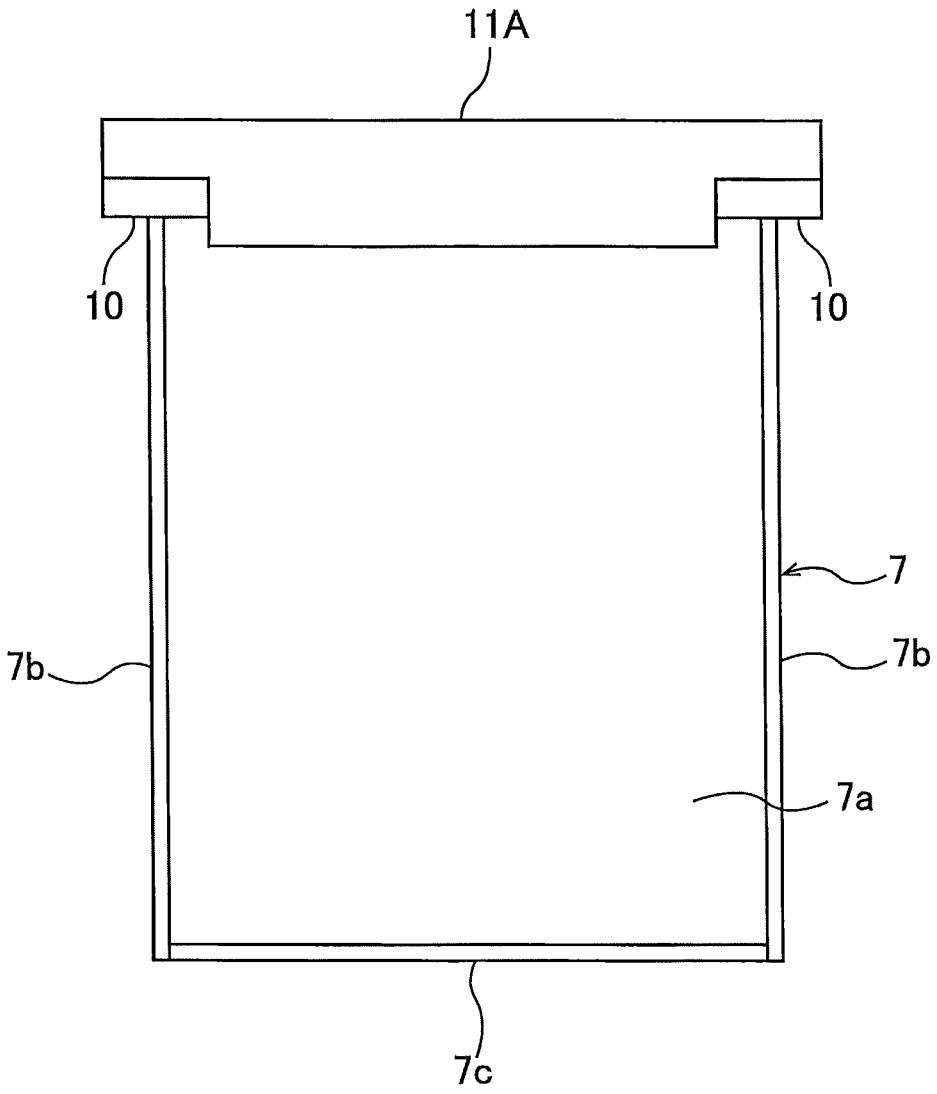
FIG. 5 is a diagram showing the frame as viewed in a direction of arrow A shown in FIG. 2.
Figure 6:
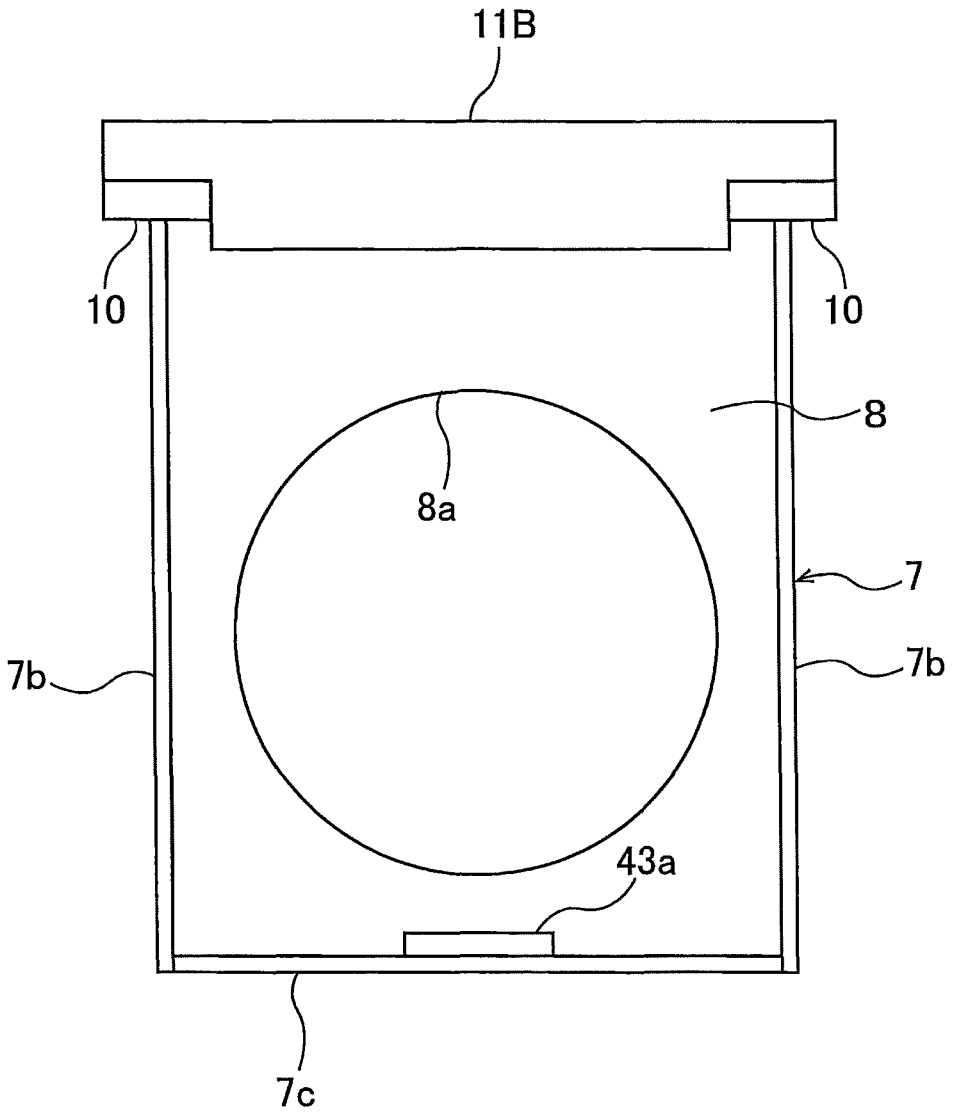
FIG. 6 is a diagram showing the frame as viewed in a direction of arrow B shown in FIG. 2.

The frame 6 will now be described with reference to FIGS. 2 through 16. FIG. 2 is a side view of the frame 6, and FIG. 3 is a cross-sectional side view of the frame 6. FIG. 4 is a plan view of the frame 6. FIG. 5 is a diagram showing the frame 6 as viewed in a direction of arrow A shown in FIG. 2, and FIG. 6 is a diagram showing the frame 6 as viewed in a direction of arrow B shown in FIG. 2. The frame 6 includes two supports 10, 10 on which upper portions of the anode holder 2, the substrate holder 3 and the regulation plate 4 are to be placed. The supports 10, 10 extend parallel to each other in a horizontal direction. Both ends of one support 10 are coupled to both ends of the other support 10 by bridges 11A, 11B.

The supports 10, 10 and the bridges 11A, 11B are made of a metal, such as titanium (Ti), and have a hard and rigid construction. Therefore, when the anode holder 2 holding the anode 1, the substrate holder 3 holding the substrate W, and the regulation plate 4 are placed on the supports 10, 10, the supports 10, 10 do not bend substantially.

The frame 6 includes a box structure 7 having a shape that surrounds the anode holder 2 and the regulation plate 4. The box structure 7 is an enclosing wall for preventing leakage of electric field, and is made of a material capable of blocking an electric field. The upper end of the box structure 7 is fixed to the supports 10, 10. The box structure 7 includes an end wall 7*a* located at the back side of the anode holder 2, side walls 7*b*, 7*b* located lateral to the anode holder 2 and the regulation plate 4, a bottom wall 7*c* located below the anode holder 2 and the regulation plate 4, and a shield wall 8 disposed parallel to the end wall 7*a*.

The side walls 7*b*, 7*b* extend in the longitudinal direction of the supports 10, 10, with the upper ends of the side walls 7*b*, 7*b* being fixed to the supports 10, 10, respectively. The end wall 7*a*, the side walls 7*b*, 7*b* and the shield wall 8 extend vertically downward from the supports 10, 10. The bottom wall 7*c* horizontally extends parallel to the supports 10, 10. The end wall 7*a* and the shield wall 8 are disposed opposite each other. Both sides of the end wall 7*a* and both sides of the shield wall 8 are connected to the side walls 7*b*, 7*b*. The lower ends of the end wall 7*a*, the side walls 7*b*, 7*b* and the shield wall 8 are connected to the bottom wall 7*c*. The bottom wall 7*c* extends further outward from the shield wall 8. The shield wall 8 has a circular or vertically-elongated elliptical opening 8*a* whose diameter is slightly larger than the outer diameter of the cylindrical portion 5 of the regulation plate 4.

The box structure 7 is made of a hard resin, such as polyvinyl chloride (PVC) or polyvinylidene fluoride (PVDF). The box structure 7 is a structure which has high mechanical strength and hardly deforms. Since the box structure 7 is fixed to the supports 10, 10, the box structure 7 serves to reinforce the supports 10, 10.

Anode holder positioning protrusions 12, 12 (hereinafter simply referred to as positioning protrusions 12, 12) for fixing the horizontal position of the anode holder 2 are provided on the upper surfaces of the supports 10, 10, respectively. Similarly, a first positioning block 22 and a second positioning block 23 for fixing the horizontal position of the regulation plate 4 are provided on the upper surfaces of the supports 10, 10, respectively; and substrate holder positioning protrusions 13, 13 (hereinafter simply referred to as positioning protrusions 13, 13) for fixing the horizontal position of the substrate holder 3 are provided on the upper surfaces of the supports 10, 10, respectively. Positioning pins each having a thin tip can be used as the positioning protrusions 12, 12 and the positioning protrusions 13, 13.

Anode holder stoppers 42, 42 for fixing the angle of the anode holder 2 with respect to a horizontal plane are provided on the bottom wall 7*c* of the box structure 7. Similarly, a regulation plate stopper 44 for fixing the angle of the regulation plate 4 with respect to a horizontal plane is provided on the bottom wall 7*c*; and substrate holder stoppers 43, 43 for fixing the angle of the substrate holder 3 with respect to a horizontal plane are provided on the bottom wall 7*c*.

Figure 7:
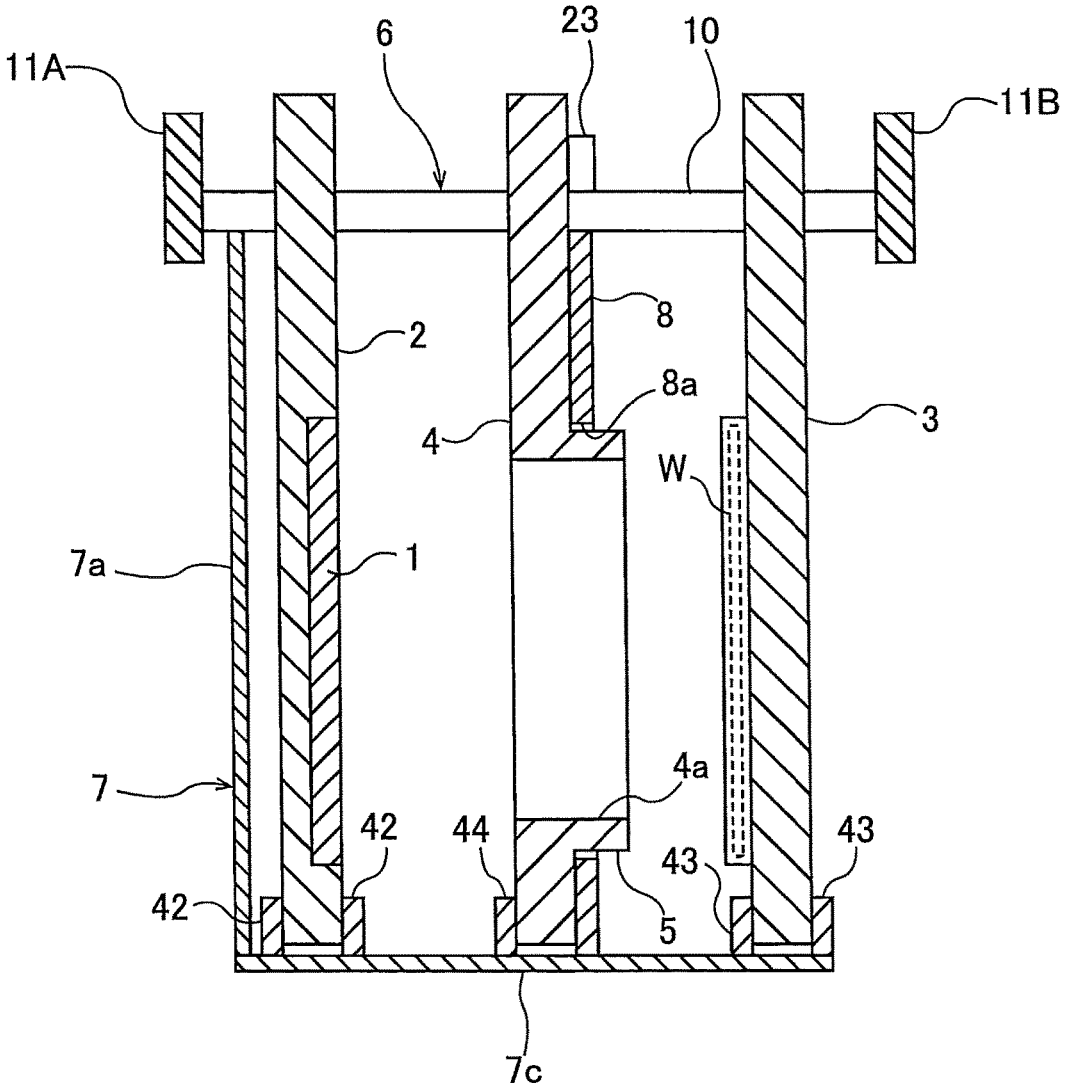
FIG. 7 is a cross-sectional side view showing an anode holder, a regulation plate and a substrate holder when they are set at predetermined positions in the frame.
Figure 8:
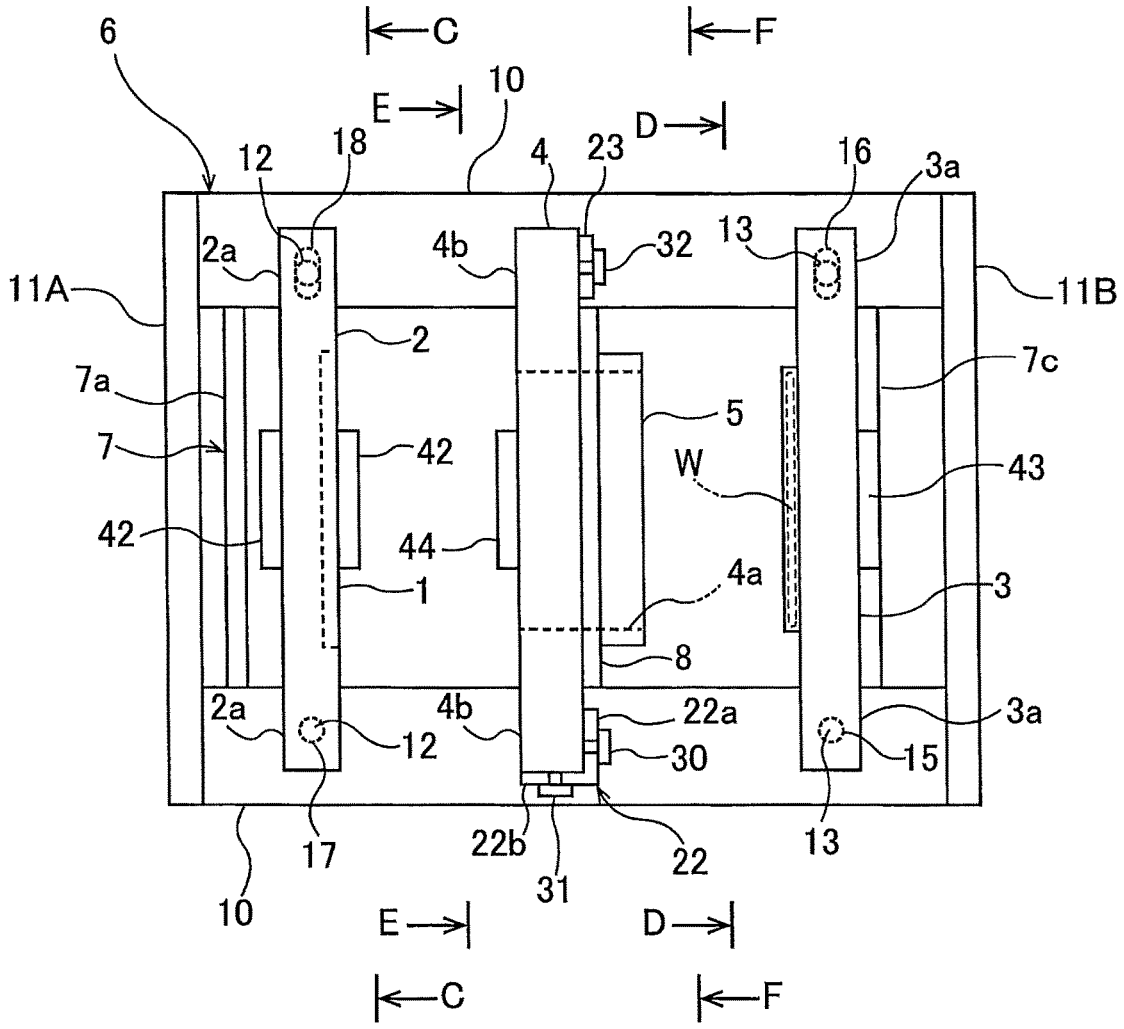
FIG. 8 is a plan view showing the anode holder, the regulation plate and the substrate holder when they are set at predetermined positions in the frame.
Figure 9:
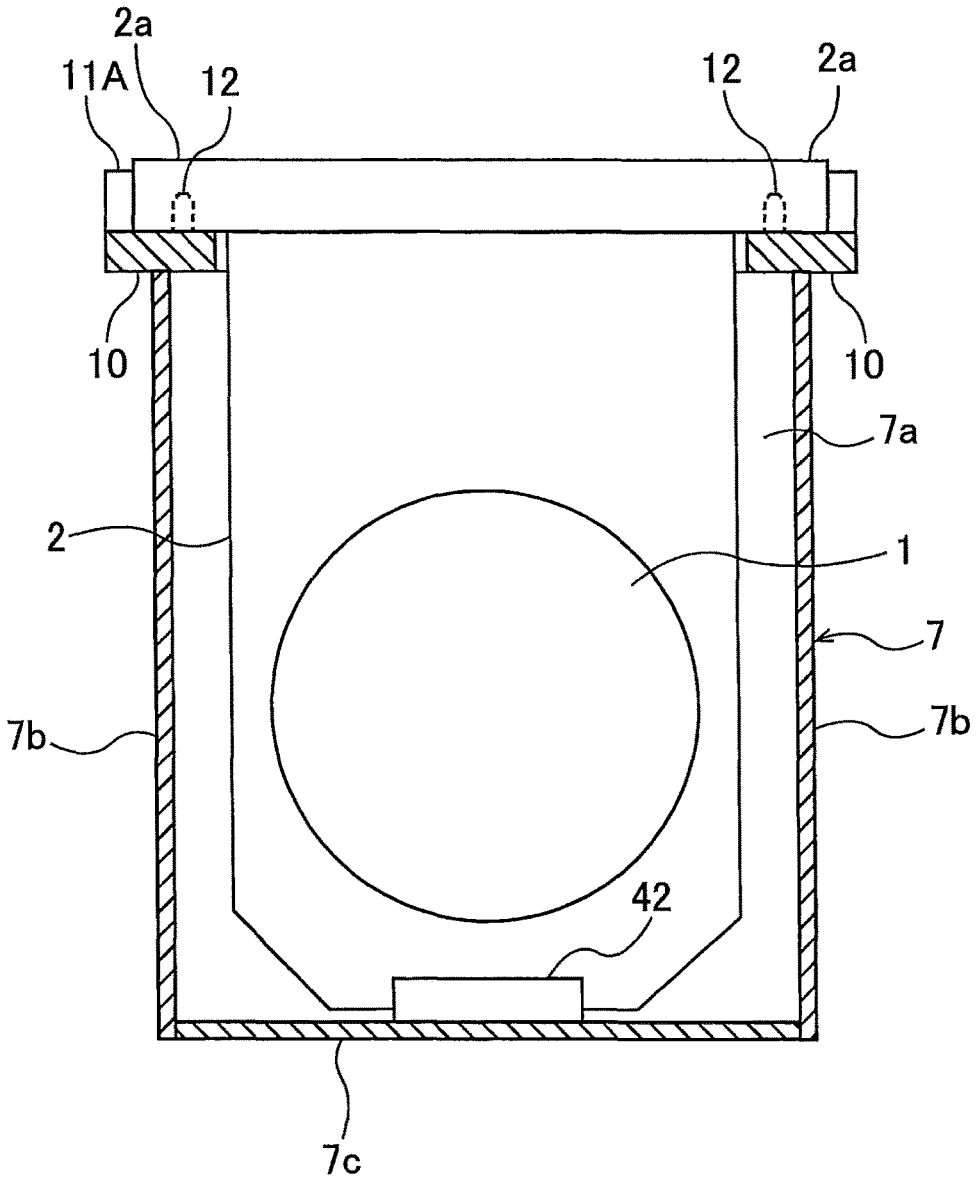
FIG. 9 is a cross-sectional view taken along line C-C of FIG. 8.
Figure 10:
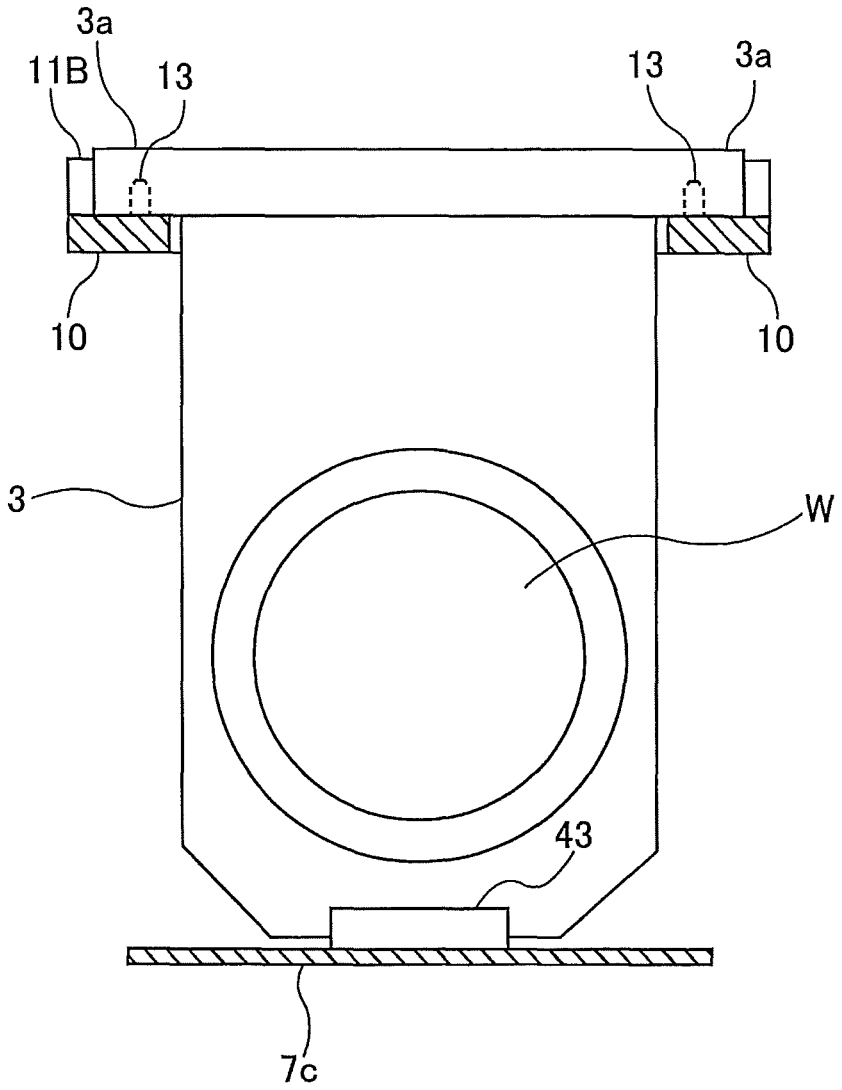
FIG. 10 is a cross-sectional view taken along line D-D of FIG. 8.
Figure 11:
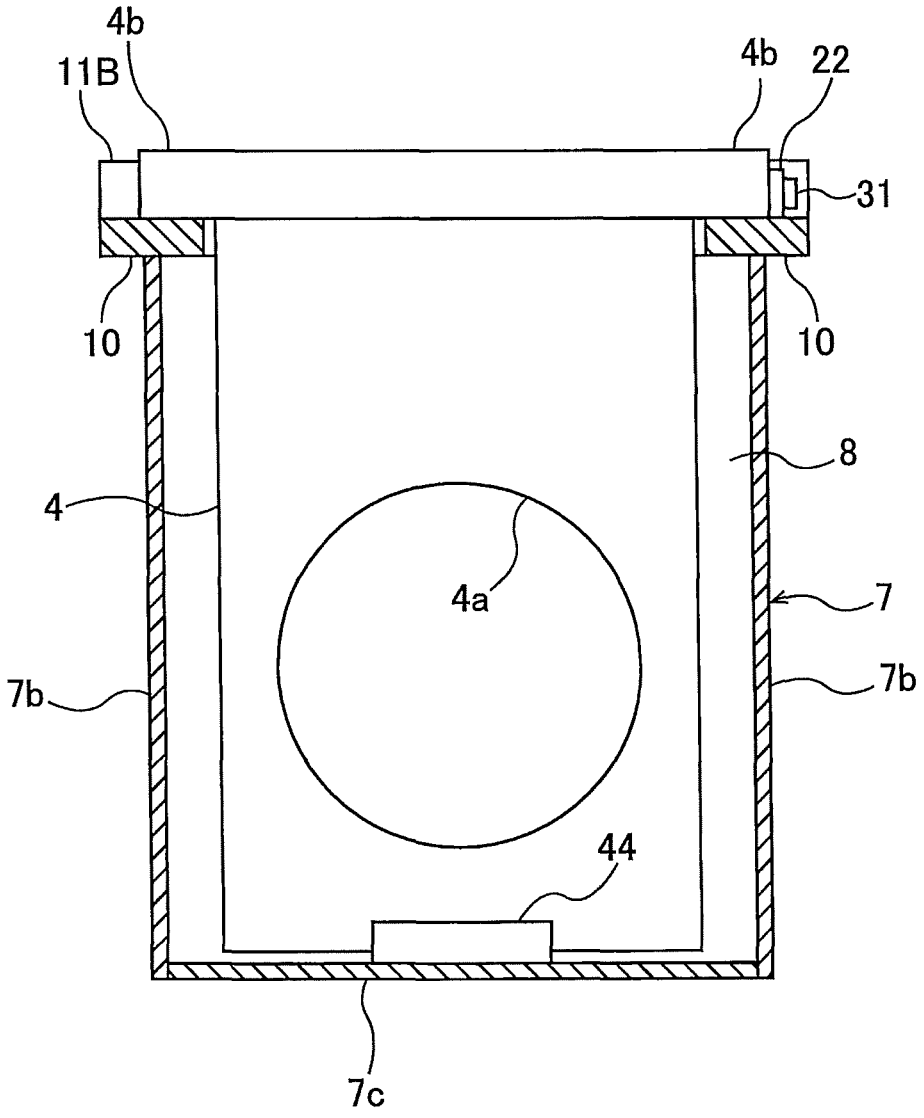
FIG. 11 is a cross-sectional view taken along line E-E of FIG. 8.
Figure 12:
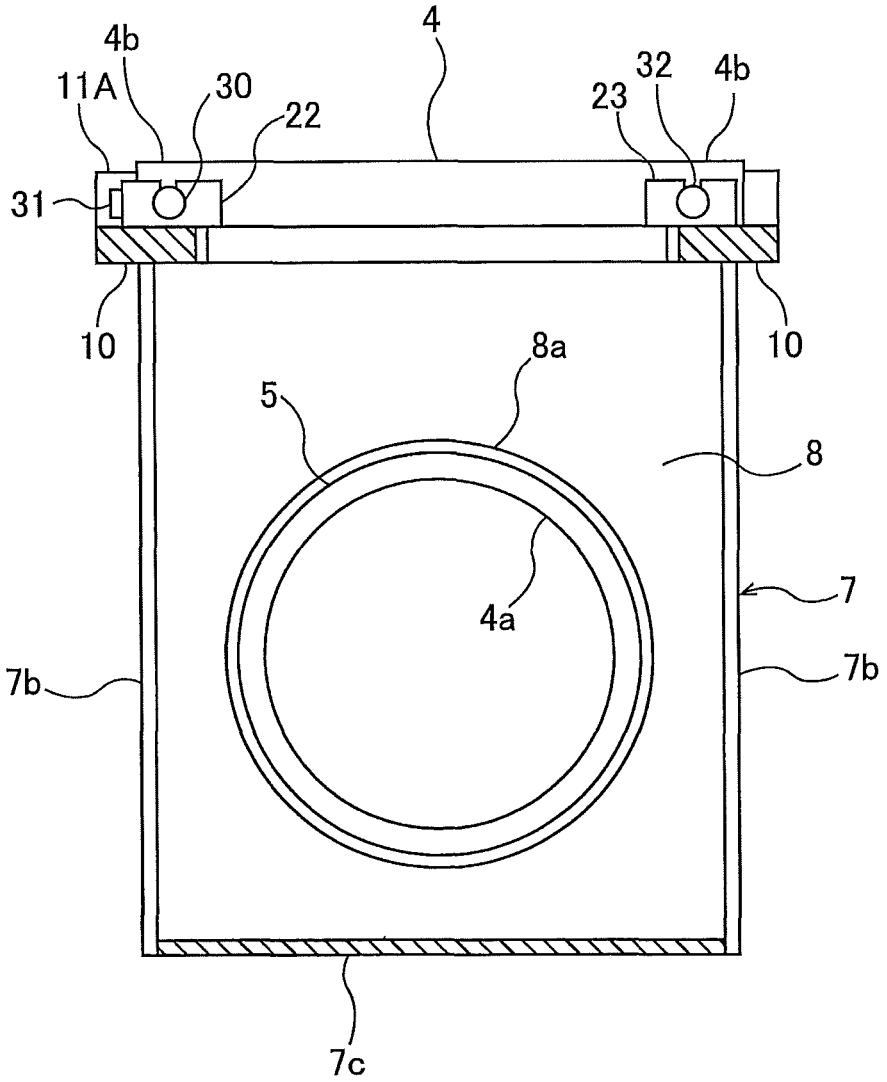
FIG. 12 is a cross-sectional view taken along line F-F of FIG. 8.

FIG. 7 is a cross-sectional side view showing the anode holder 2, the regulation plate 4 and the substrate holder 3 when they are set at predetermined positions in the frame 6, and FIG. 8 is a plan view showing the anode holder 2, the regulation plate 4 and the substrate holder 3 when they are set at predetermined positions in the frame 6. FIG. 9 is a cross-sectional view taken along the line C-C of FIG. 8, FIG. 10 is a cross-sectional view taken along the line D-D of FIG. 8, FIG. 11 is a cross-sectional view taken along the line E-E of FIG. 8, and FIG. 12 is a cross-sectional view taken along the line F-F of FIG. 8.

The anode holder 2 has, in an upper portion thereof, hanger portions 2*a*, 2*a* extending horizontally outward, which are to be placed on the supports 10, 10, respectively. The hanger portions 2*a*, 2*a* have positioning holes 17, 18 formed at positions corresponding to the positioning protrusions 12, 12. The hanger portions 2*a*, 2*a* of the anode holder 2 are placed on the supports 10, 10 in such a manner that the positioning protrusions 12, 12 are inserted into the positioning holes 17, 18, respectively.

The positioning hole 17 has a shape such that the positioning protrusion 12 fits into the positioning hole 17 with no gap between them. On the other hand, the positioning hole 18 is an elongated hole which is elongated in a direction of a straight line (imaginary line) connecting the positioning protrusions 12, 12. When the positioning protrusions 12, 12 are inserted into the positioning holes 17, 18, a relative position between the upper portion of the anode holder 2 and the supports 10, 10 is fixed. The reason why the positioning hole 18 is an elongated hole is to prevent the generation of a stress in the anode holder 2 when it is held by the positioning protrusions 12, 12, thereby preventing deformation of the anode holder 2.

Simultaneously with the insertion of the positioning protrusions 12, 12 into the positioning holes 17, 18, the lower portion (more specifically the lower end) of the anode holder 2 is held by the anode holder stoppers 42, 42. The anode holder stoppers 42, 42 are protrusions disposed parallel to each other, and are provided on the bottom wall 7*c* of the box structure 7.

The distance between the anode holder stoppers 42, 42 is substantially equal to the thickness of the lower portion (or lower end) of the anode holder 2. Therefore, when the lower portion of the anode holder 2 is inserted into the space between the anode holder stoppers 42, 42, the relative position between the lower portion of the anode holder 2 and the box structure 7 is fixed. The position of the lower portion of the anode holder 2 is thus fixed while the position of the upper portion of the anode holder 2 is fixed; therefore, the angle of the anode holder 2 with respect to a horizontal plane is fixed. Thus, the anode holder 2 is held in a vertical position.

The substrate holder 3 has, in an upper portion thereof, hanger portions 3*a*, 3*a* extending horizontally outward, which are to be placed on the supports 10, 10. The hanger portions 3*a*, 3*a* have positioning holes 15, 16 formed at positions corresponding to the positioning protrusions 13, 13. The hanger portions 3*a*, 3*a* of the substrate holder 3 are placed on the supports 10, 10 in such a manner that the positioning protrusions 13, 13 are inserted into the positioning holes 15, 16, respectively.

The positioning hole 15 has a shape such that the positioning protrusion 13 fits into the positioning hole 15 with no gap between them. On the other hand, the positioning hole 16 is an elongated hole which is elongated in a direction of a straight line (imaginary line) connecting the positioning protrusions 13, 13. When the positioning protrusions 13, 13 are inserted into the positioning holes 15, 16, a relative position between the upper portion of the substrate holder 3 and the supports 10, 10 is fixed. The reason why the positioning hole 16 is an elongated hole is to prevent the generation of a stress in the substrate holder 3 when it is held by the positioning protrusions 13, 13, thereby preventing deformation of the substrate holder 3.

Simultaneously with the insertion of the positioning protrusions 13, 13 into the positioning holes 15, 16, the lower portion (more specifically the lower end) of the substrate holder 3 is held by the substrate holder stoppers 43, 43. The substrate holder stoppers 43, 43 are protrusions disposed parallel to each other, and are provided on the bottom wall 7*c* of the box structure 7.

The distance between the substrate holder stoppers 43, 43 is substantially equal to the thickness of the lower portion (or lower end) of the substrate holder 3. Therefore, when the lower portion of the substrate holder 3 is inserted into the space between the substrate holder stoppers 43, 43, the relative position between the lower portion of the substrate holder 3 and the box structure 7 is fixed. The position of the lower portion of the substrate holder 3 is thus fixed while the position of the upper portion of the substrate holder 3 is fixed; therefore, the angle of the substrate holder 3 with respect to a horizontal plane is fixed. Thus, the substrate holder 3 is held in a vertical position.

The regulation plate 4 has, in an upper portion thereof, hanger portions 4*b*, 4*b* extending horizontally outward, which are to be placed on the supports 10, 10, respectively. More specifically, the hanger portions 4*b*, 4*b* of the regulation plate 4 are placed on the supports 10, 10 in such a manner that the hanger portions 4*b*, 4*b* make contact with the first positioning block 22 and the second positioning block 23, respectively.

The first positioning block 22, when viewed from above, has a shape of the letter "L". More specifically, the first positioning block 22 is an L-shaped block including a first stopper block 22*a* extending along the front surface of the hanger portion 4*b* of the regulation plate 4, and a second stopper block 22*b* extending along the end surface of the hanger portion 4*b* of the regulation plate 4. The first stopper block 22*a* and the second stopper block 22*b* are connected perpendicularly.

Figure 13A:
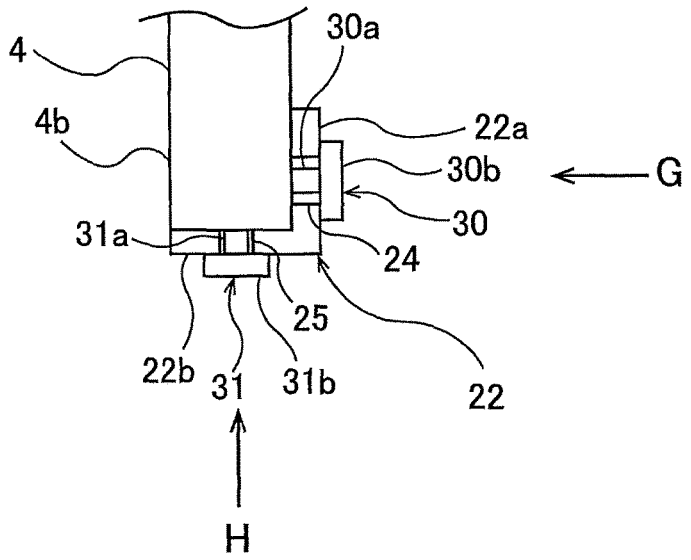
FIG. 13A is a plan view of a first positioning block and a hanger portion of the regulation plate, shown in FIG. 8.
Figure 13B:
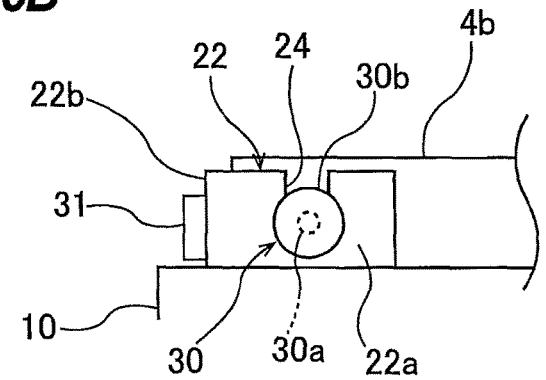
FIG. 13B is a diagram of the first positioning block and the hanger portion of the regulation plate, shown in FIG. 13A, as viewed in a direction of arrow G.
Figure 13C:
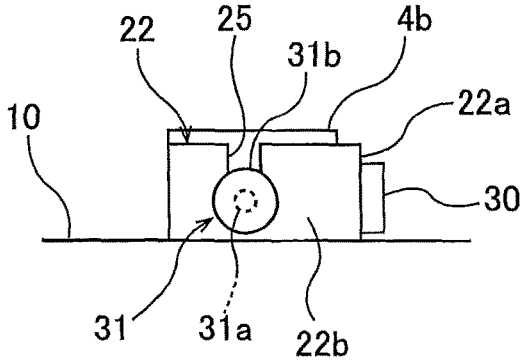
FIG. 13C is a diagram of the first positioning block and the hanger portion of the regulation plate, shown in FIG. 13A, as viewed in a direction of arrow H.

FIG. 13A is a plan view of the first positioning block 22 and the hanger portion 4*b* of the regulation plate 4, shown in FIG. 8, FIG. 13B is a diagram of the first positioning block 22 and the hanger portion 4*b* of the regulation plate 4, shown in FIG. 13A, as viewed in a direction of arrow G, and FIG. 13C is a diagram of the first positioning block 22 and the hanger portion 4*b* of the regulation plate 4, shown in FIG. 13A, as viewed in a direction of arrow H.

The hanger portion 4*b* of the regulation plate 4 is fixed to the first stopper block 22*a* by a screw 30. The screw 30 includes a male-threaded portion 30*a* and a screw head portion 30*b*. A female thread (not shown), into which the male-threaded portion 30*a* is to be inserted, is formed in the hanger portion 4*b* of the regulation plate 4. The first stopper block 22*a* has a vertically-extending cutout 24. The male-threaded portion 30*a* of the screw 30 is screwed into the female thread through the cutout 24. The width of the cutout 24 is larger than the diameter of the male-threaded portion 30*a* and smaller than the diameter of the screw head portion 30*b*.

The hanger portion 4*b* of the regulation plate 4 is further fixed to the second stopper block 22*b* by a screw 31. The screw 31 includes a male-threaded portion 31*a* and a screw head portion 31*b*. A female thread (not shown), into which the male-threaded portion 31*a* is to be inserted, is formed in the hanger portion 4*b* of the regulation plate 4. The second stopper block 22*b* has a vertically-extending cutout 25. The male-threaded portion 31*a* of the screw 31 is screwed into the female thread through the cutout 25. The width of the cutout 25 is slightly larger than the diameter of the male-threaded portion 31*a* and smaller than the diameter of the screw head portion 31*b*.

Figure 14A:
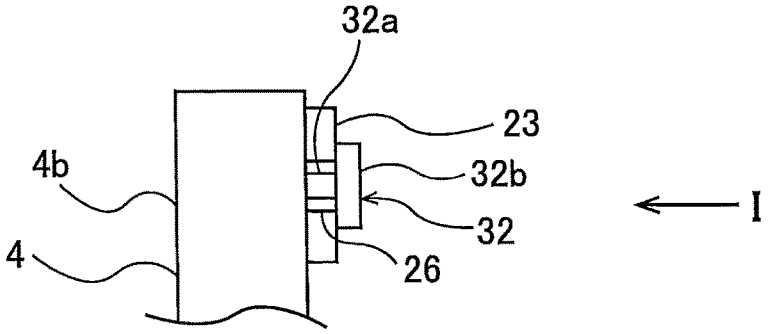
FIG. 14A is a plan view of a second positioning block and the hanger portion of the regulation plate, shown in FIG. 8.
Figure 14B:
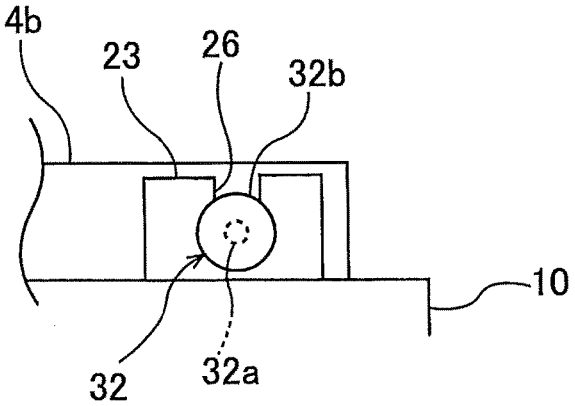
FIG. 14B is a diagram of the second positioning block and the hanger portion of the regulation plate, shown in FIG. 14A, as viewed in a direction of arrow I.

FIG. 14A is a plan view of the second positioning block 23 and the hanger portion 4*b* of the regulation plate 4, shown in FIG. 8, and FIG. 14B is a diagram of the second positioning block 23 and the hanger portion 4*b* of the regulation plate 4, shown in FIG. 14A, as viewed in a direction of arrow I. The second positioning block 23 is a plate-shaped block extending along the front surface of the hanger portion 4*b* of the regulation plate 4. The second positioning block 23 is aligned with the first stopper block 22*a* of the first positioning block 22.

The hanger portion 4*b* of the regulation plate 4 is fixed to the second positioning block 23 by a screw 32. The screw 32 includes a male-threaded portion 32*a* and a screw head portion 32*b*. A female thread (not shown), into which the male-threaded portion 32*a* is to be inserted, is formed in the hanger portion 4*b* of the regulation plate 4. The second positioning block 23 has a vertically-extending cutout 26. The male-threaded portion 32*a* of the screw 32 is screwed into the female thread through the cutout 26. The width of the cutout 26 is larger than the diameter of the male-threaded portion 32*a* and smaller than the diameter of the screw head portion 32*b*.

The regulation plate 4 is placed on the frame 6 in such a manner that the cylindrical portion 5 of the regulation plate 4 is inserted into the opening 8*a* of the shield wall 8. The hanger portions 4*b*, 4*b* of the regulation plate 4 are fixed to the positioning blocks 22, 23 by the screws 30, 31, 32, whereby the relative position between the upper portion of the regulation plate 4 and the supports 10, 10 is fixed.

Simultaneously with the placement of the hanger portions 4*b*, 4*b* of the regulation plate 4 on the supports 10, 10, the lower portion (more specifically the lower end) of the regulation plate 4 is held by the regulation plate stopper 44 and the shield wall 8. The regulation plate stopper 44 is a protrusion disposed parallel to the shield wall 8, and is disposed on the bottom wall 7*c* of the box structure 7 at a position adjacent to the lower end of the shield wall 8.

The distance between the regulation plate stopper 44 and the shield wall 8 is substantially equal to the thickness of the lower portion (or lower end) of the regulation plate 4. Therefore, when the lower portion of the regulation plate 4 is inserted into the space between the regulation plate stopper 44 and the shield wall 8, the relative position between the lower portion of the regulation plate 4 and the box structure 7 is fixed. The position of the lower portion of the regulation plate 4 is thus fixed while the position of the upper portion of the regulation plate 4 is fixed; therefore, the angle of the regulation plate 4 with respect to a horizontal plane is fixed. Thus, the regulation plate 4 is held in a vertical position.

A clearance is formed between the male-threaded portion 30*a* of the screw 30 and the cutout 24, and a clearance is formed between the male-threaded portion 32*a* of the screw 32 and the cutout 26. Accordingly, the horizontal position of the regulation plate 4 can be finely adjusted within the range of the clearance between the male-threaded portion 30*a*, 32*a* and the cutout 24, 26. Further, since the cutouts 24, 25, 26 extend vertically, the vertical position of the regulation plate 4 can also be finely adjusted.

Figure 15A:
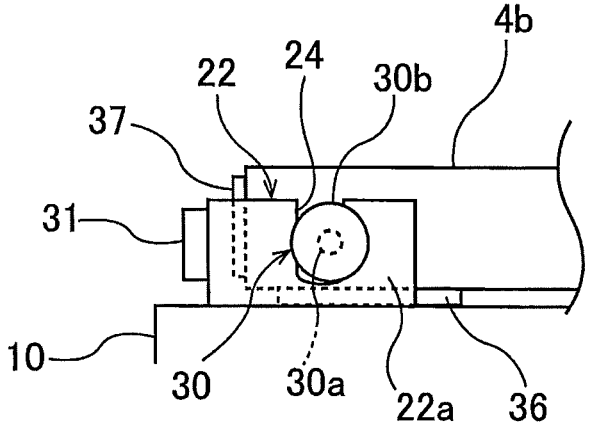
FIGS. 15A and 15B are diagrams illustrating a spacer disposed between the lower surface of the hanger portion of the regulation plate and the upper surface of a support, and a spacer disposed between the end surface of the hanger portion of the regulation plate and the first positioning block.
Figure 15B:
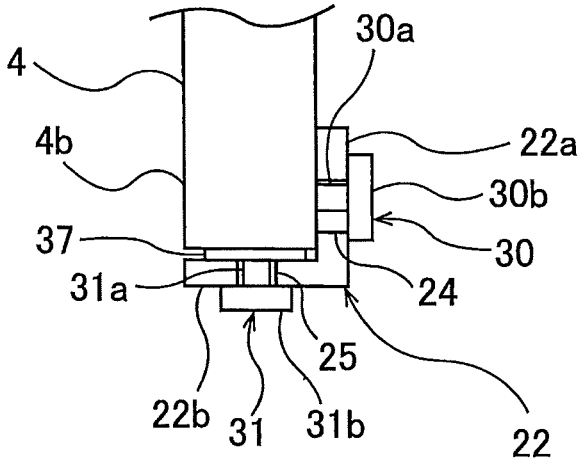
Figure 16:
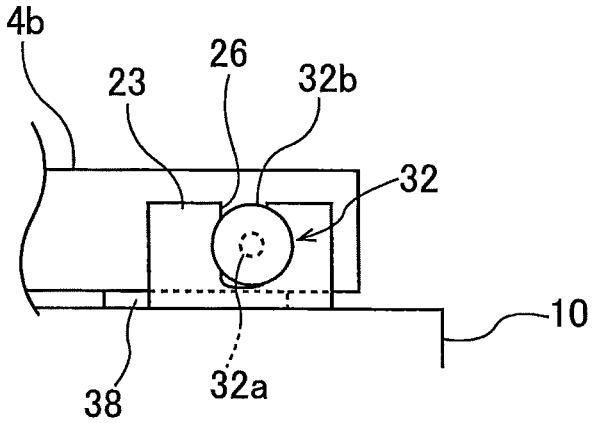
FIG. 16 is a diagram illustrating a spacer disposed between the lower surface of the hanger portion of the regulation plate and the upper surface of the support.
Figure 17:
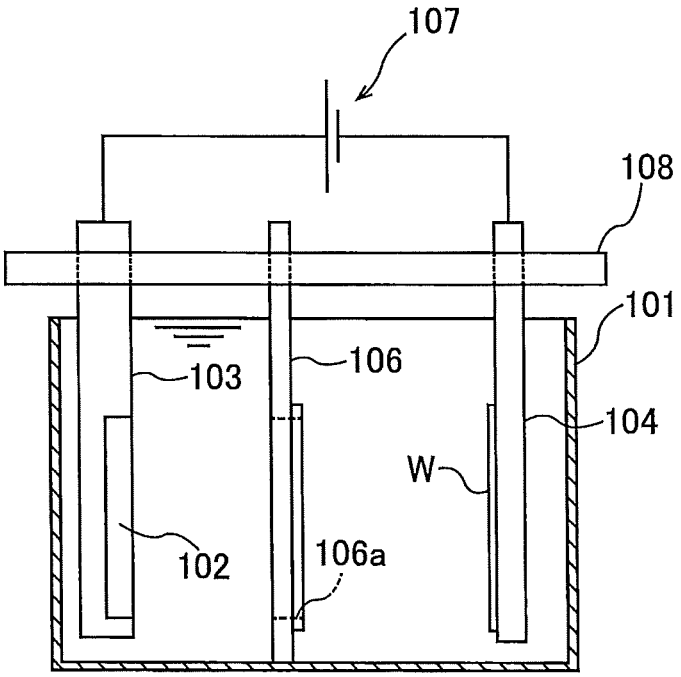
FIG. 17 is a diagram illustrating a typical plating apparatus.

FIGS. 15A and 15B are diagrams illustrating a spacer 36 disposed between the lower surface of the hanger portion 4*b* of the regulation plate 4 and the upper surface of the support 10, and a spacer 37 disposed between the end surface of the hanger portion 4*b* of the regulation plate 4 and the first positioning block 22. FIG. 16 is a diagram illustrating a spacer 38 disposed between the lower surface of the hanger portion 4*b* of the regulation plate 4 and the upper surface of the support 10. As shown in FIGS. 15A, 15B and 16, the use of the spacers 36, 37 and 38 enables fine adjustment of the vertical and horizontal positions of the regulation plate 4. The fine adjustment of the position of the regulation plate 4 may be performed for optimizing the distribution of electric potential in accordance with a pattern configuration of a substrate to be plated. Since the diameter of the opening 8*a* of the shield wall 8 is larger than the outer diameter of the cylindrical portion 5 of the regulation plate 4, the adjustment of the position of the regulation plate 4 is not inhibited by the shield wall 8.

As shown in FIG. 1, the anode holder 2 and the regulation plate 4 are disposed inside the box structure 7, while the substrate holder 3 is disposed outside the box structure 7. When a voltage is applied between the anode 1 and the substrate W in the presence of a plating solution held in the plating tank 5, an electric current flows from the anode 1 to the substrate W through the opening 4*a* of the regulation plate 4. Since the box structure 7 is configured to block an electric field, the electric field does not leak out of the box structure 7 except through the opening 4*a* of the regulation plate 4. The electric field can therefore be regulated depending on the size of the opening 4*a* of the regulation plate 4.

The box structure 7 is fixed to the supports 10, 10. Since the box structure 7 is a strong and rigid structure, the supports 10, 10 are reinforced by the box structure 7, so that the mechanical strength of the supports 10, 10 is increased. Further, the supports 10, 10 are formed of a metal which is unlikely to deform. Therefore, when the anode holder 2, the substrate holder 3 and the regulation plate 4 are mounted to the frame 6, the supports 10, 10 are not bent due to the weights of the anode holder 2, the substrate holder 3 and the regulation plate 4; the frame 6 can stably support the anode holder 2, the substrate holder 3 and the regulation plate 4.

When the anode holder 2, the substrate holder 3 and the regulation plate 4 are set on the frame 6, the positions of the upper portions of the anode holder 2, the substrate holder 3 and the regulation plate 4 are fixed by the positioning protrusions 12, 13 and the positioning blocks 22, 23, while the positions of the lower portions of the anode holder 2, the substrate holder 3 and the regulation plate 4 are fixed by the anode holder stoppers 42, the substrate holder stoppers 43 and the regulation plate stopper 44. The positioning protrusions 12, 13 and the positioning blocks 22, 23 constitute an upper positioning structure for fixing the positions of the upper portions of the anode holder 2, the substrate holder 3 and the regulation plate 4, while the anode holder stoppers 42, the substrate holder stoppers 43 and the regulation plate stopper 44 constitute a lower positioning structure for fixing the positions of the lower portions of the anode holder 2, the substrate holder 3 and the regulation plate 4.

The positioning protrusions 12, 13, the positioning blocks 22, 23 and the stoppers 42, 43, 44 have been installed in advance at such positions as to make the anode holder 2, the substrate holder 3 and the regulation plate 4 parallel to each other, and to make the center of the anode 1, the center of the opening 4*a* of the regulation plate 4, and the center of the substrate W are aligned in a straight line. Accordingly, accurate positioning of the anode holder 2, the substrate holder 3 and the regulation plate 4 can be effected simply by setting the anode holder 2, the substrate holder 3 and the regulation plate 4 in the frame 6.

After the frame 6 is set in the plating tank 50, the anode holder 2 and the regulation plate 4 are set on the frame 6. Thereafter, a plating solution is supplied into the plating tank 50, and then the substrate holder 3 is set on the frame 6. A voltage is applied between the anode 1 and the substrate W to form a metal film having a uniform thickness on the surface of the substrate W.

Upon completion of the plating of the substrate W, the substrate holder 3 holding the substrate W is taken by a transport device (not shown) out of the plating tank 50. Since the positioning protrusions 13, 13 of the frame 6 have been simply inserted into the holes 15, 16 of the substrate holder 3, the substrate holder 3 can be easily detached from the frame 6 by raising the substrate holder 3. After the substrate holder 3 is taken out of the plating tank 50, another substrate holder 3 holding another substrate is set on the frame 6.

The anode holder 2 has been set on the frame 6 with the same mechanism as used for setting the substrate holder 3. Therefore, the anode holder 2 can be easily detached from the frame 6 by raising the anode holder 2, and can be easily set in the frame 6 by lowering the anode holder 2.

The foregoing description is presented to enable a person of ordinary skill in the art to make and use the invention. Various modifications to the embodiments described above will be readily apparent to those of ordinary skill in the art and the technical concept of the present invention may be applied to other embodiments. Accordingly, the present invention is not intended to be limited to the embodiments illustrated but is to be accorded the widest scope consistent with the technical concept defined by the appended claims.

What is claimed is:

1. A plating apparatus comprising:

a plating tank;

a substrate holder for holding a substrate;

an anode holder for holding an anode;

a regulation plate for regulating the distribution of electric potential on the substrate held by the substrate holder; and a frame for positioning the substrate holder, the anode holder and the regulation plate in the plating tank, the frame including:

a support that supports upper portions of the anode holder, the substrate holder and the regulation plate;

a box structure having a side wall extending in a longitudinal direction of the support, the side wall being fixed to the support to reinforce the support;

an upper positioning structure for fixing a relative position between the support and the upper portions of the anode holder, the substrate holder and the regulation plate; and a lower positioning structure for fixing a relative position between the box structure and lower portions of the anode holder, the substrate holder and the regulation plate.

2. The plating apparatus according to claim 1, wherein the upper positioning structure is provided on the support, and the lower positioning structure is provided in the box structure.

3. The plating apparatus according to claim 1, wherein the upper positioning structure includes at least a positioning protrusion to be inserted into a positioning hole formed in the substrate holder.

4. The plating apparatus according to claim 1, wherein the support is made of a metal.

5. The plating apparatus according to claim 1, wherein the box structure has a shape that surrounds the anode holder and the regulation plate supported by the support.

6. The plating apparatus according to claim 5, wherein the box structure is made of a material capable of blocking an electric field.

7. The plating apparatus according to claim 1, wherein the box structure includes a bottom wall secured to the side wall.

8. The plating apparatus according to claim 7, wherein the lower positioning structure is disposed on the bottom wall.

9. The plating apparatus according to claim 1, wherein the box structure includes a shield wall having an opening, the shielding wall being located between the anode holder and the substrate holder.

10. The plating apparatus according to claim 9, wherein the regulation plate is in contact with the shielding wall.

11. The plating apparatus according to claim 1, further comprising bridges secured to both ends of the support, respectively.

12. The plating apparatus according to claim 1, wherein the side wall has an upper end extending in the longitudinal direction of the support, the upper end being fixed to the support.

13. The plating apparatus according to claim 1, wherein the side wall is in contact with the support.

* * * * *